US007350244B1

(12) United States Patent
Handley

(10) Patent No.: US 7,350,244 B1
(45) Date of Patent: Apr. 1, 2008

(54) DETACHABLE SHOWER LINER

(76) Inventor: Ana Handley, 1101 Loyola Dr., Salinas, CA (US) 93901

( * ) Notice: Subject to any disclaimer, the term of this patent is extended or adjusted under 35 U.S.C. 154(b) by 99 days.

(21) Appl. No.: 11/084,908

(22) Filed: Mar. 21, 2005

(51) Int. Cl.
*A47K 3/08* (2006.01)
*A47K 3/14* (2006.01)
*A47H 1/00* (2006.01)

(52) U.S. Cl. ..... 4/558; 4/608; 4/610; 160/DIG. 6

(58) Field of Classification Search ..... 4/558, 4/557, 559, 605, 607, 608, 610; 24/716; 160/DIG. 6
See application file for complete search history.

(56) References Cited

U.S. PATENT DOCUMENTS

| | | | | |
|---|---|---|---|---|
| 3,235,926 | A | 2/1966 | Mates | |
| 4,333,187 | A | 6/1982 | Schuler | |
| 4,972,896 | A | 11/1990 | Roberts | |
| 5,109,912 | A | 5/1992 | Gary | |
| 5,337,425 | A | 8/1994 | Hill | |
| 5,586,375 | A * | 12/1996 | Cooperman et al. | 24/716 |
| 5,894,642 | A * | 4/1999 | Eberhardt | 24/716 |
| 6,038,749 | A | 3/2000 | Eberhardt | |
| 6,041,454 | A * | 3/2000 | Summerford | 4/558 |
| 6,564,435 | B1 * | 5/2003 | Chan | 24/716 |
| 2003/0131405 | A1 | 7/2003 | Greaves | |

FOREIGN PATENT DOCUMENTS

| | | |
|---|---|---|
| CA | 2.178.968 | 12/1997 |
| GB | 1.162.201 | 8/1969 |
| GB | 1.456.533 | 11/1976 |

* cited by examiner

*Primary Examiner*—Tuan Nguyen
(74) *Attorney, Agent, or Firm*—Michael I Kroll

(57) ABSTRACT

Apparatus (10) comprises a removable liner (12) for a shower curtain having a length of loop and hook fasteners (14) such as Velcro affixed to the hem. Additionally, the shower liner (12) comprises a valence-like top element 16 having reinforced eyelets (18) positioned longitudinally along the top side for the attachment of hooks (20) on rods (22) and a mating length of loop and hook fastener (24) positioned along the bottom side for mating to the removable liner (12). The loop and hook fasteners (14), (24) allow the user easy removal and reattachment of the shower liner from the valance-like element. In an alternate construction, the shower liner (12) comprises a removable liner for a shower curtain having a length of loop and hook fasteners (14), (24) affixed to both sides of the hem. The mating valance-like (16) element includes two layers of material. When attached to the valance-like element (16), the lower removable liner (12) is thus affixed on both the interior (30) and exterior (32) sides.

2 Claims, 9 Drawing Sheets

DETACHABLE SHOWER LINER

BACKGROUND OF THE INVENTION

1. Field of the Invention

The present invention relates generally to shower liners and, more specifically, to a detachable shower liner which allows for rapid hanging and removal of a shower liner.

Increasing attention is being focused on the importance of good indoor air quality and its affect on health. The EPA has named indoor air pollution as one of the most urgent national problems. While many factors can contribute to poor indoor air quality, much attention has recently been given to the detrimental affects of mold. A recent Mayo Clinic study published in 1999, cited mold as a leading cause of many respiratory problems, and a contributor to nearly 100% of chronic sinus infections.

Mold needs five basic ingredients in order to grow: food source, air, surface to grow on, suitable temperature, and moisture. A bathroom and particularly a shower curtain provide an ideal environment for mold to grow.

The shower liner of the present invention provides means to both reduce the presence of mold and mildew, and reduce the maintenance required to clean and/or replace the shower liner. It can also potentially eliminate the time and effort invested in scrubbing away mold/mildew on an ordinary liner in between replacements, as replacements could now be more often/easier and cost effective.

The shower liner of the present invention comprises a removable liner for a shower curtain having a length of loop and hook fastener such as Velcro® affixed to the hem.

Additionally, the shower liner of the present invention comprises a valance-like element having reinforced eyelets positioned longitudinally long the top side for the attachment of hooks and a mating length of loop and hook fastener positioned along the bottom side for mating to the removable liner.

The loop and hook fasteners allow the user easy removal and reattachment of the shower liner from the valance-like element. Upon the need of replacing the shower curtain, the valance-like element can be retained, allowing the user to only replace the lower curtain section. In turn, replacement costs could be reduced.

In an alternate construction, The shower liner of the present invention comprises a removable liner for a shower curtain having a length of loop and hook fasteners affixed to both sides of the hem. The mating valance-like element includes two layers of material. When attached to the valance-like element, the lower removable liner is thus affixed on both the interior and exterior sides. The dual attachment provides increased holding strength. When the shower curtain is hung between the mating valance's interior and exterior layers, the seam is protected from exposure.

2. Description of the Prior Art

There are other shower curtain liners designed for the same purpose. Typical of these is U.S. Pat. No. 3,235,926 issued to Mates on Feb. 22, 1966.

Another patent was issued to Roberts on Nov. 27, 1990 as U.S. Pat. No. 4,972,896. Yet another U.S. Pat. No. 5,109,912 was issued to Gary on May 5, 1992 and still yet another was issued on Aug. 16, 1994 to Hill as U.S. Pat. No. 5,337,425.

Another patent was issued to Eberhardt on Mar. 21, 2000 as U.S. Pat. No. 6,038,749. Yet another U.S. Pat. No. 6,041,454 was issued to Summerford on Mar. 28, 2000. Another was filed by Greaves on Jul. 17, 2003 as U.S. Patent Application No. US2003/0131405 and still yet another was issued on Aug. 20, 1969 to Wylde UK Patent No. GB1,162,201.

Another patent was issued to Huppe on Nov. 24, 1976 as UK Patent No. GB 1,456,533. Yet another Canadian Patent No. 2,178,968 was issued to Moseson on Dec. 15, 1997.

U.S. Pat. No. 3,235,926

Inventor: Jack K. Mates

Issued: Nov. 27, 1990

A drapery hardware for using in hanging and arranging drapery material from a support, said hardware comprising a pile fabric tape sewn to the drapery material, the pile fabric tape comprising a base fabric and a plurality of raised threads in the form of loops, a tape fastener having a stiff foundation and a plurality of raised threads of synthetic resin material engaging hooks adapted to engage the loops of the pile fabric tape and a drapery fitting secured to the tape fastener, the drapery fitting further comprising a support for engagement with a support means, the drapery fitting being adapted to support the drapery material when the tape fastener is engaged with the pile fabric tape.

U.S. Pat. No. 4,333,187

Inventor: Bob A. Schuler

Issued: Jun. 8, 1982

An integrated plastic shower curtain assembly including a pair of rectangular curtain panels secured together in overlapping relationship along inside vertical edge portions by a securing strip folded over and heat sealed with horizontal top edge portions of the curtain panels. A horizontal plastic net panel is secured along a bottom edge portion with the curtain panels by the securing strip. The vertical outside side edges of the curtain panels are each provided with a securing strip of Velcro and is connected along each outside vertical side edge of the curtain panels and a similar strip is provided for connection with an adjacent vertical wall surface for securing the outside vertical edges of the panels with walls at opposite sides or ends of a shower enclosure. Each of the curtain panels has a tie back along each vertical outside edge for gathering and holding the curtains apart for entry and exit into and out of the shower enclosure. Spaced shower hooks are used to support the curtain assembly from a horizontal rod. At the opposite ends of the assembly, a bracket is used having a supporting rod for holding the net panel at an upwardly and inwardly extending angle with the ceiling over the shower enclosure to minimize movement of moisture from the shower enclosure outwardly into the surrounding room.

U.S. Pat. No. 4,972,896

Inventor: Dennis E. Roberts

Issued: Nov. 27, 1990

A covering apparatus is set forth to overlie an existing covered opening such as found in window and door environments. The apparatus includes a continuous elongate strip secured to a window or door frame opening with a companion strip receivable therein integrally secured and formed as a perimeter of a flexible transparent covering membrane for the window or door opening.

U.S. Pat. No. 5,109,912

Inventor: Leonard Gary

Issued: May 5, 1992

A drapery system which allows for rapid hanging and removal of drapes has carriers which are connected to the drape panels using strips of Velcro material. Velcro material is secured to the drape panels at selected areas, such that when joined to the carriers, which also have a Velcro material secured thereto (of a type which will mate with the Velcro material on the panels), the drapes will hang uniformly from the track. The strips of Velcro material on the drape panels can also be used in one embodiment to control the depth and number of folds in the panels. The panels can optionally have pockets in the heading for the connection of the carriers such that the carriers and material to which they are fastened are hidden on both sides of the drapes.

U.S. Pat. No. 5,337,425

Inventor: Jane Hill

Issued: Aug. 16, 1994

An improved shower curtain for a shower enclosure of the type having a bathtub, a back wall and a side wall, the improved shower curtain including a first track bent in a U-shaped configuration, attachable to a back ledge, a free side ledge and a front ledge of the bathtub, the first track has a channel that is solely vertically C-shaped in cross section, a second track bent in a U-shaped configuration, spaced above the first track and attachable along one portion to the back wall, while its distal ends are attachable to the side wall, the second track has a channel that is solely vertically C-shaped in cross-section, an elongated sheet of flexible waterproof material sized to fit between and about the first track and the second track, a first unit for detachably securing a lower marginal edge of the sheet to the first track, the first detachably securing includes a plurality of spaced apart first fibrous fastener elements attached along the lower marginal edge of the sheet, a plurality of slide members that ride entirely within the solely vertical C-shaped channel of the first track, and a plurality of second fibrous fastener elements, each affixed to each of the slide members, so that the first fibrous fastener elements can detachably interlock with the second fibrous fastener elements, and a second unit for detachably securing an upper marginal edge of the sheet to the second track, the second detachably securing unit includes a plurality of spaced apart first fibrous fastener elements attached along the upper marginal edge of the sheet, a plurality of slide members that ride entirely within the solely vertical C-shaped channel of the second track, and a plurality of second fibrous fastener elements, each affixed to each of the slide members, so that the first fibrous fastener elements can detachably interlock with the second fibrous fastener elements, so that the sheet will be sealed thereto, to retain water within the shower enclosure.

U.S. Pat. No. 6,038,749

Inventor: Stephanie Eberhardt

Issued: Mar. 21, 2000

A combined shower curtain and liner construction held together by hook and loop strips, wherein the liner sheet is attached below the hook apertures of the shower curtain sheet.

U.S. Pat. No. 6,041,454

Inventor: Sharon Kay Summerford

Issued: Mar. 28, 2000

A shower curtain system comprising a generally rectangular shower curtain sheet assembly having an upper horizontal edge and a lower horizontal edge and lateral vertical side edges. A plurality of coupling straps each having an interior edge and with an exterior edge positioned to be removably coupled to the sheet and with an intermediate supporting loop between the interior edge and exterior edge for being slidably received on the shower rod. A plurality of detachable weights are removably positioned on the lower edge of the shower curtain.

U.S. Patent Number US 2003/0131404

Inventor: Judy Greaves

Issued: Jul. 17, 2003

A shower curtain assembly which includes a shower curtain having a plurality of straps, each of the straps using a hook and loop structure for securing the straps to a main body of the shower curtain to thereby form a plurality of loops for hanging the shower curtain on a curtain rod. The shower curtain assembly of the present invention also includes a shower curtain liner that employs a hook and loop structure for securing the liner to the shower curtain.

UK Patent Number GB 1,162,201

Inventor: Joseph Wylde

Issued: Aug. 20, 1969

A curtain attachment means comprising a runner, the runner being arranged for suspension from a curtain rail or the like, and an attachment member directly connected to the runner, the member providing a surface having upstanding therefrom a plurality of filamentary elements arranged for releasable engagement with cooperating filamentary elements on a curtain or on a member secured to a curtain UK Patent Number 1 456 533

Inventor: Justin Huppe

Issued: Nov. 24, 1976

Shower unit partitioning comprising a pair of folding walls each having at its leading edge a frame member in which is mounted a magnetic strip which is so positioned and oriented that the strips of the respective walls cooperate to hold the leading edges of the walls together when the walls are set in mutually perpendicular vertical planes and their leading edges meet at the junction of the planes.

Canadian Patent Number CA2,178,968

Inventor: Yehuda Moseson

Issued: Dec. 15, 1997

This invention creates a system with the capability and methodology for sealing the junctions between shower curtains and bathtub or shower stall or whirlpool surface thereby preventing water leakage into areas surrounding bathtubs or shower stalls or whirlpools.

While these drapery systems devices may be suitable for the purposes for which they were designed, they would not be as suitable for the purposes of the present invention, as hereinafter described.

SUMMARY OF THE PRESENT INVENTION

The shower liner of the present invention comprises a removable liner for a shower curtain having a length of loop and hook fasteners such as Velcro affixed to the hem. Additionally, the shower liner of the present invention comprises a valence-like top element having reinforced eyelets positioned longitudinally along the top side for the attachment of hooks on rods and a mating length of loop and hook fastener positioned along the bottom side for mating to the removable liner. The loop and hook fasteners allow the user easy removal and reattachment of the shower liner from the valance-like element. In an alternate construction, the shower liner of the present invention comprises a removable liner for a shower curtain having a length of loop and hook fasteners affixed to both sides of the hem. The mating valance-like element includes two layers of material. When attached to the valance-like element, the lower removable liner is thus affixed on both the interior and exterior sides.

A primary object of the present invention is to provide a detachable portion for a shower curtain that provides means for selectively replacing the detachable portion.

Another object of the present invention is to provide a shower curtain comprising a valance element and a sheet element.

Yet another object of the present invention is to provide a curtain wherein the valance portion provides the bar engaging apertures along the topside with a length of hook and loop material fastened to the bottom side.

Still yet another object of the present invention is to provide a sheet portion having a length of hook and loop material fastened hem-like along one side whereby said sheet portion can matingly engage said valance portion through their respective hook and loop members.

Another object of the present invention is to provide a detachable shower liner which allows for rapid hanging and removal of a shower liner comprising a removable liner for a shower curtain.

Yet another object of the present invention is to provide a shower curtain having a length of Velcro® fastened to the hem.

Still yet another object of the present invention is to provide a valance-like element having reinforced eyelets positioned longitudinally along the top side for the attachment of hooks.

Another object of the present invention is to provide a mating length of Velcro® positioned along the bottom side for mating to the removable liner.

Additional objects of the present invention will appear as the description proceeds.

The present invention overcomes the shortcomings of the prior art by providing a detachable shower liner which allows for rapid hanging and removal of a shower liner comprising a removable liner for a shower curtain having a length of Velcro® fastened to the hem; a valance-like element having reinforced eyelets positioned longitudinally along the top side for the attachment of hooks and a mating length of Velcro® positioned along the bottom side for mating to the removable liner.

The foregoing and other objects and advantages will appear from the description to follow. In the description reference is made to the accompanying drawing, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
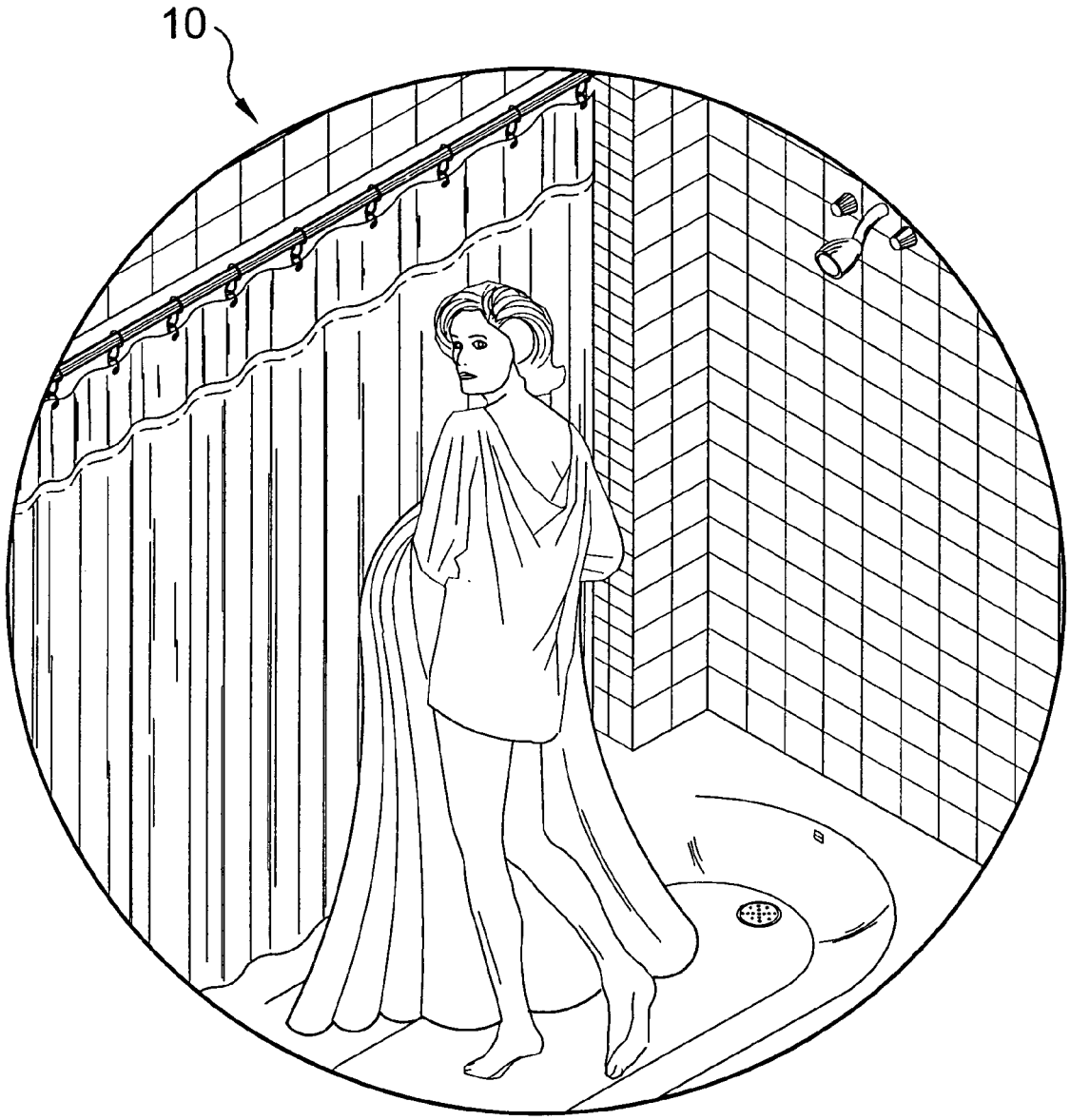
FIG. 1 is an illustrative view of the present invention in use.

With regard to reference numerals used, the following numbering is used throughout the drawings.

10 present invention
12 liner
14 hook and loop material
16 top element
18 eyelets
20 hooks
22 rod
24 mating hook and loop material
26 shower
28 rings
30 interior surface
32 exterior surface

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 comprises a removable liner that allows for the rapid hanging and removal of a shower liner having a length of Velcro® fastened to the hem and a valance-like element having reinforced eyelets positioned longitudinally along the top side for the attachment of hooks and a mating length of Velcro® positioned along the bottom side for mating to the removable liner.

Figure 2:
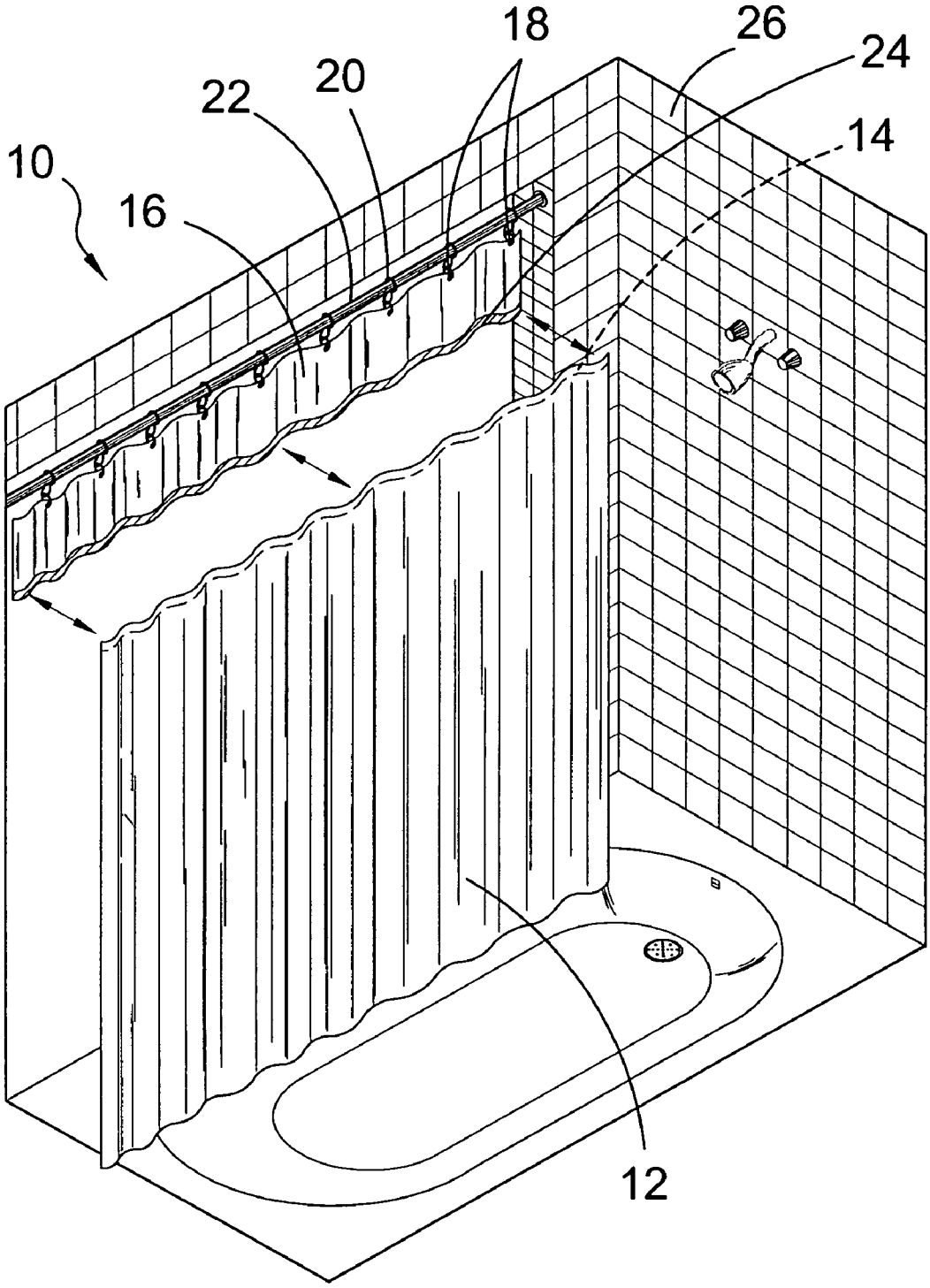
FIG. 2 is a perspective view of the present invention with curtain liner removed.

Turning to FIG. 2, shown therein is a perspective view of the present invention 10 with curtain liner 12 removed. The present invention 10 discloses a removable liner 12 for a shower curtain 26 having a length of Velcro® or hook and loop material 14 fastened to the hem, a valance-like top element 16 having reinforced eyelets 18 positioned longitudinally along the top side for the attachment of hooks 20 on rod 22 and a mating length of Velcro® 24 positioned along the bottom side for mating to the removable liner. The present invention 10 allows for rapid hanging and removal of a shower liner 12.

Figure 3:
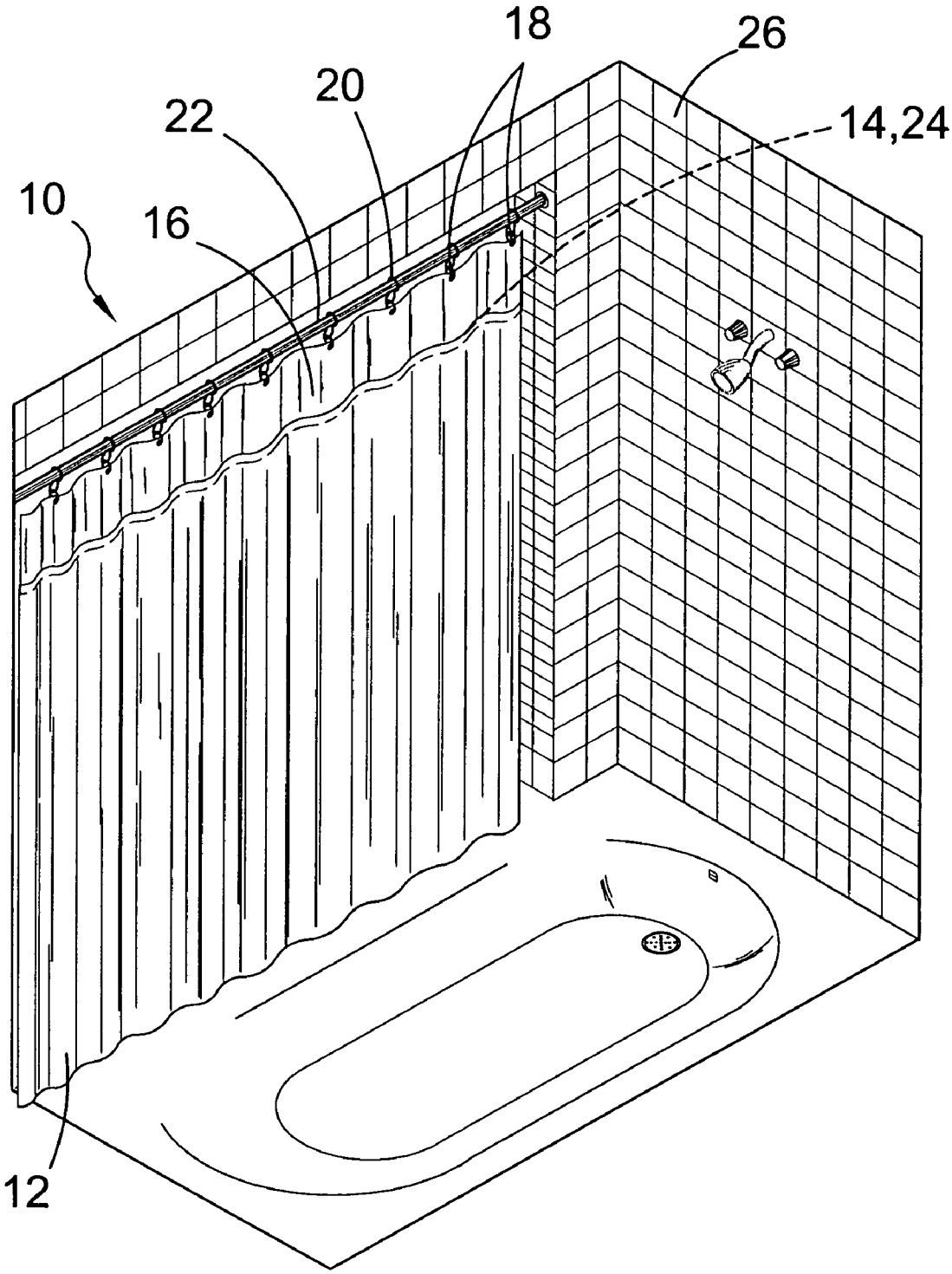
FIG. 3 is a perspective view of the present invention in an attached position.

Turning to FIG. 3, shown therein is a perspective view of the present invention 10 in an attached position. Shown is the present invention 10 disclosing a removable liner 12 for a shower curtain having a length of Velcro® 14 fastened to the hem, a valance-like 16 element having reinforced eyelets 18 positioned longitudinally along the top side for the attachment of hooks 20 on rod 22 and a mating length of Velcro® 24 positioned along the bottom side for mating to the removable liner. The present invention 10 allows for rapid hanging and removal of a shower liner 12 in shower 26.

Figure 4:
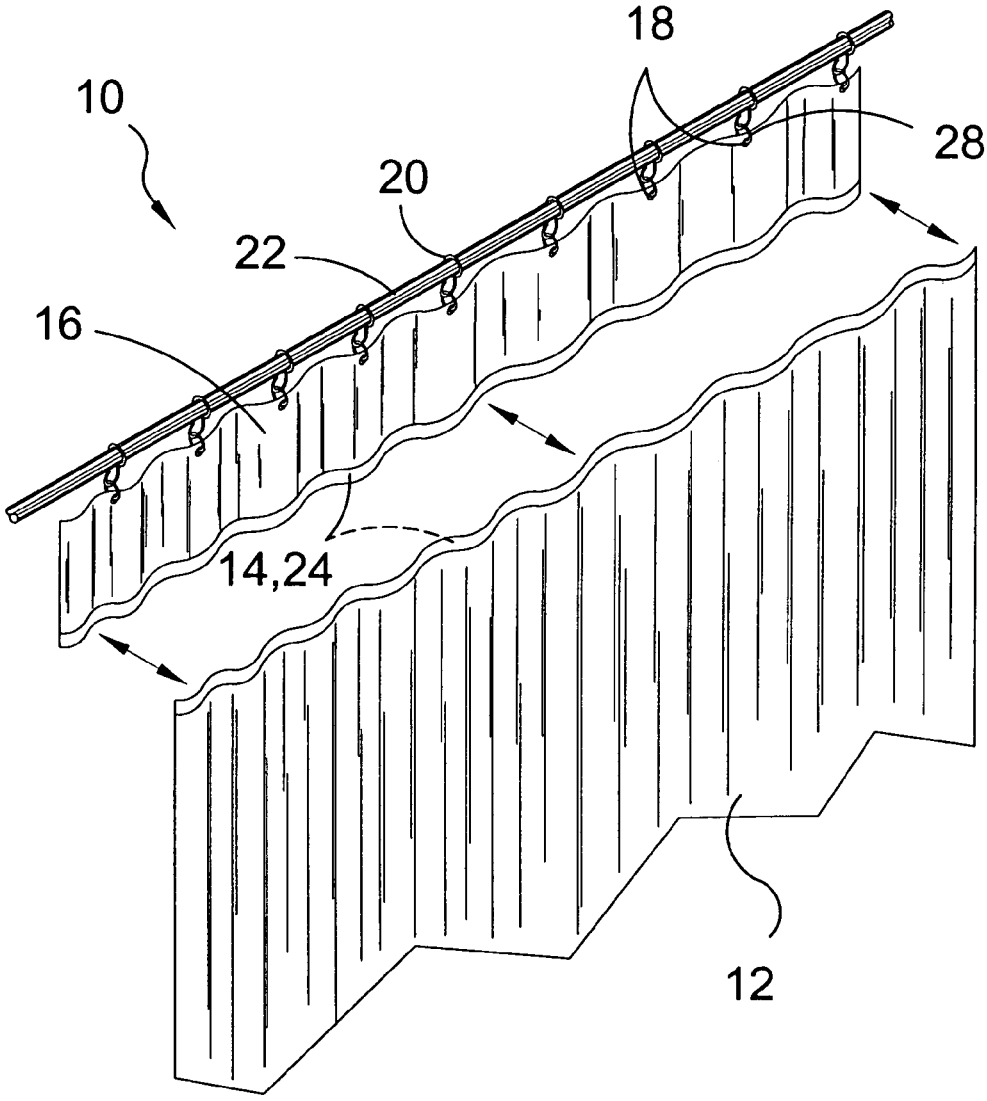
FIG. 4 is a detailed perspective view of the present invention removed from its mating parts.

Turning to FIG. 4, shown therein is a detailed perspective view of the present invention 10 having its mating parts separated. Shown is the present invention 10 disclosing a removable liner 12 for a shower curtain having a length of Velcro® 14, 24 fastened to the hem, a valance-like 16 element having reinforced eyelets 18 positioned longitudinally along the top side for the attachment of hooks 20 on rod 22 and a mating length of Velcro® 24 positioned along the bottom side for mating to the removable liner. The present invention 10 allows for rapid hanging and removal of a shower liner 12. Also shown are curtain rings 28.

Figure 5:
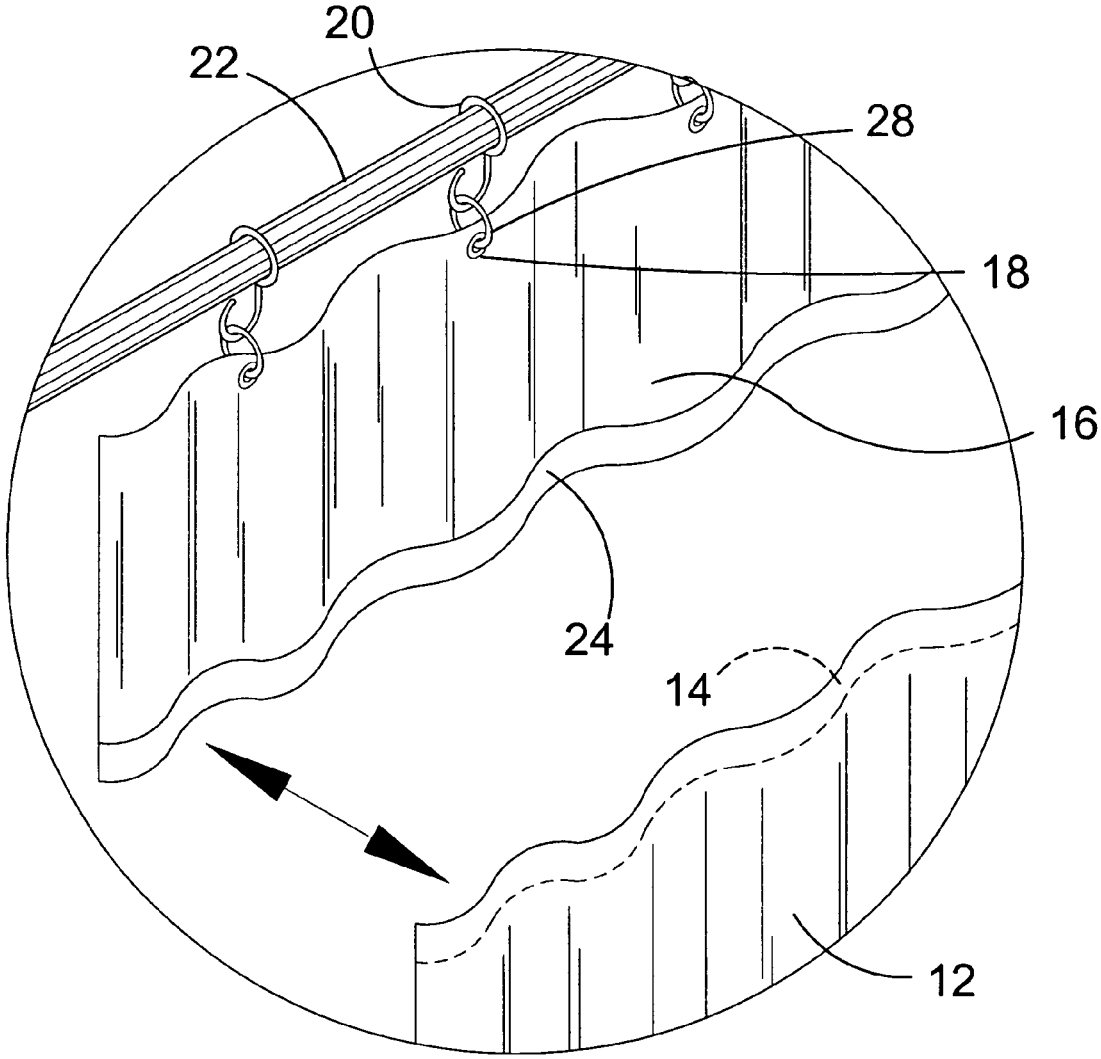
FIG. 5 is a detailed view of the present invention removed from its mating parts.

Turning to FIG. 5, shown therein is a detailed view of the present invention 10 having its mating parts separated. Shown is the present invention 10 disclosing a removable liner 12 for a shower curtain having a length of Velcro® 14 fastened to the hem, a valance-like top element 16 having reinforced eyelets 18 positioned longitudinally along the top side for the attachment of hooks 20 on rod 22 and a mating length of Velcro® 24 positioned along the bottom side for mating to the removable liner. The present invention 10 allows for rapid hanging and removal of a shower liner. Also shown are curtain rings 28.

Figure 6:
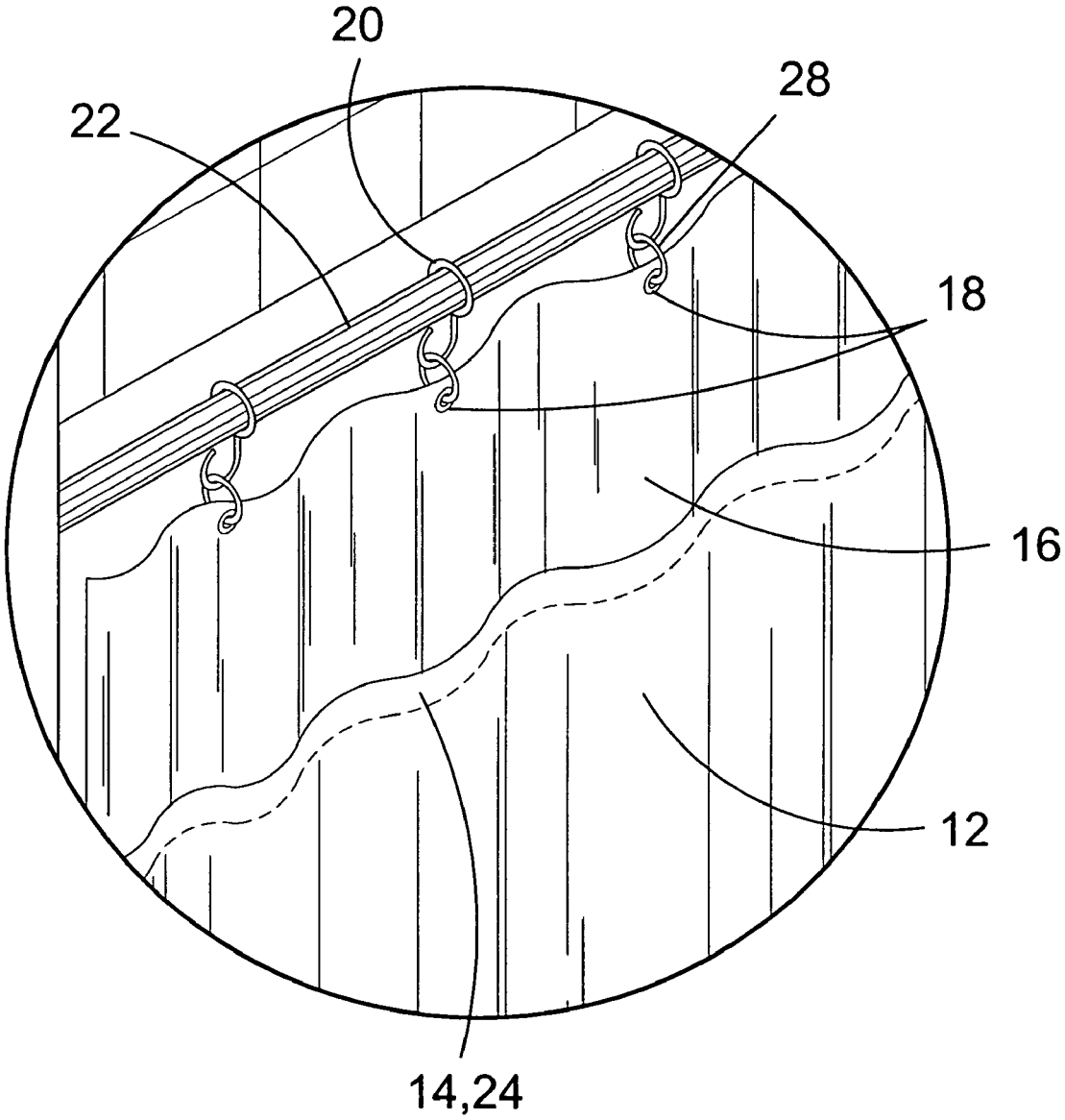
FIG. 6 is a detailed view of the present invention with attached mating parts.

Turning to FIG. 6, shown therein is a detailed view of the present invention 10 with mating parts attached. Shown is the present invention 10 disclosing a removable liner 12 for a shower curtain having a length of Velcro® 24 fastened to the hem, a valance-like element 16 having reinforced eyelets 18 positioned longitudinally along the top side for the attachment of hooks 20 on rod 22 and a mating length of Velcro® 24 positioned along the bottom side for mating to the removable liner. The present invention 10 allows for rapid hanging and removal of a shower liner 12. Also shown are rings 28.

Figure 7:
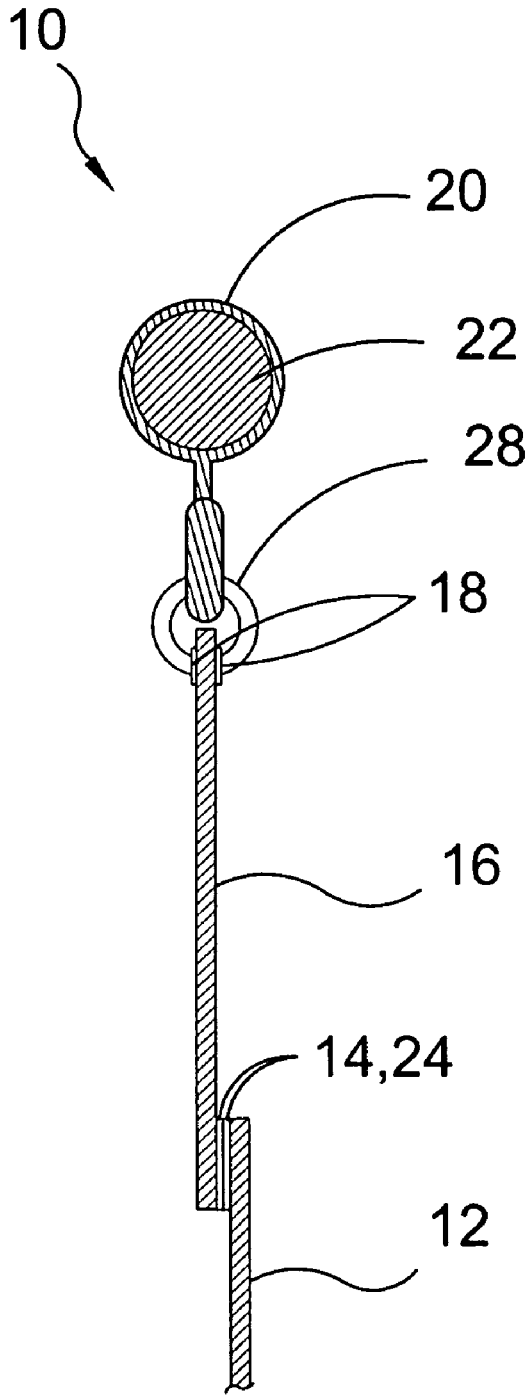
FIG. 7 is a sectional view of the present invention with attached mating parts.

Turning to FIG. 7, shown therein is a sectional view of the present invention 10 with mating parts attached. Shown is the present invention 10 disclosing a removable liner 12 for a shower curtain having a length of Velcro® 14 fastened to the hem, a valance-like element 16 having reinforced eyelets 18 positioned longitudinally along the top side for the attachment of hooks 20 on rod 22 and a mating length of Velcro® 24 positioned along the bottom side for mating to the removable liner. The present invention 10 allows for rapid hanging and removal of a shower liner 12. Also shown are rings 28. The top element 16 may be 6-12 inches long in certain embodiments.

Figure 8:
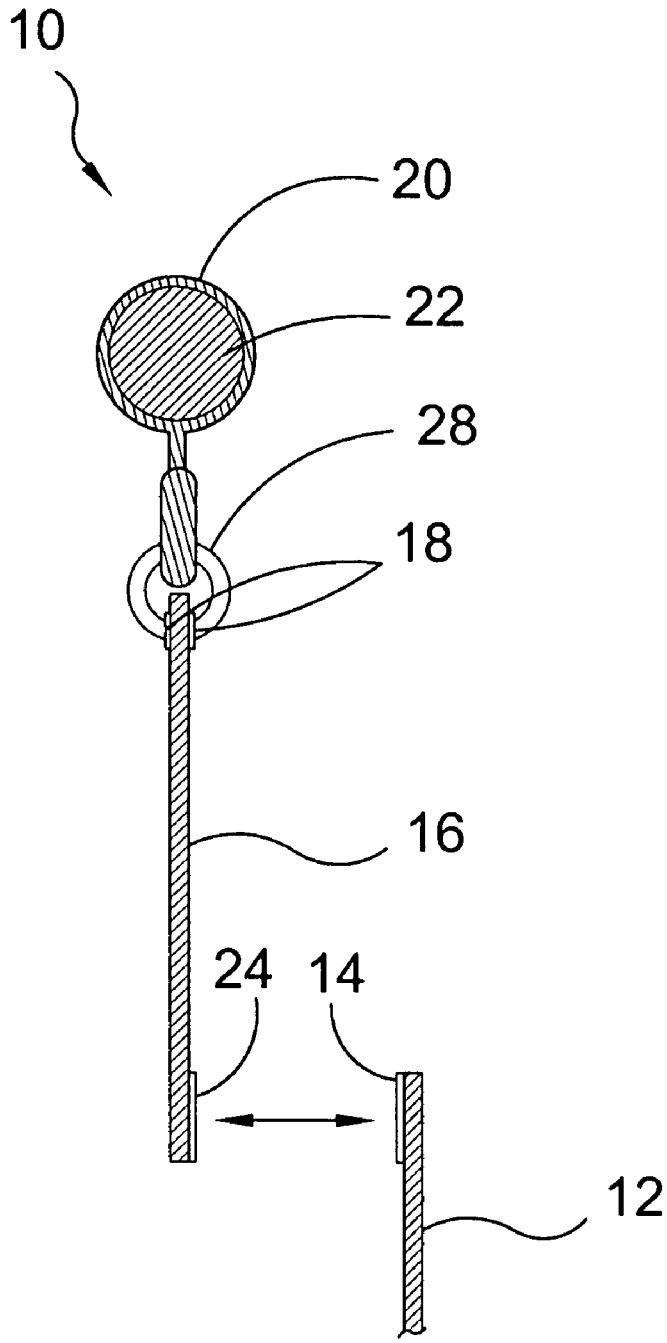
FIG. 8 is a sectional view of the present invention with removed mating parts.

Turning to FIG. 8, shown therein is a sectional view of the present invention 10 with removed mating parts. Shown is the present invention 10 disclosing a removable liner 12 for a shower curtain having a length of Velcro® 14 fastened to the hem, a valance-like element 16 having reinforced eyelets 18 positioned longitudinally along the top side for the attachment of hooks 20 on rod 22 and a mating length of Velcro® 24 positioned along the bottom side for mating to the removable liner. Also shown are rings 28.

Figure 9:
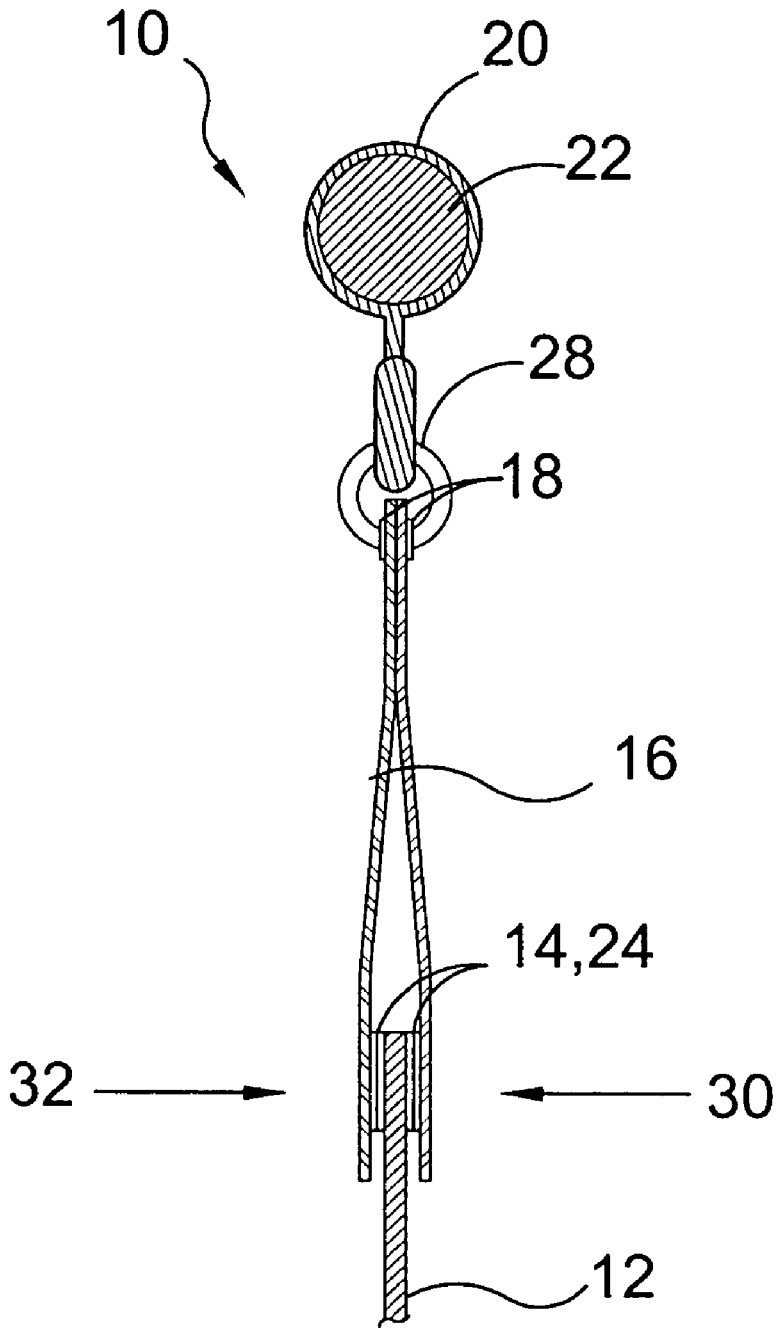
FIG. 9 is a sectional view of the present invention with alternate construction.

Turning to FIG. 9, shown therein is a sectional view of the present invention 10 with alternate construction. In an alternate construction, the shower liner of the present invention 10 comprises a removable liner 12 for a shower curtain having a length of loop and hook fasteners such as Velcro® 14 affixed to both sides of the hem. The mating valance-like element 16 includes two layers of material. When attached to the valance-like element 16, the lower removable liner 12 is thus affixed on both the interior and exterior sides. The dual attachment provides increased holding strength. When the shower curtain 12 is hung between the mating valance's interior 30 and exterior 32 layers, the seam is protected from exposure. Other previously disclosed elements are also shown.

I claim:

1. A shower liner for attachment to a shower rod using a plurality of hooks, consisting of:

a) a first piece of material having first and second contiguous layers extending continuously along a length of said shower rod, each layer having top and bottom edges, first and second sides and first and second ends having a plurality of eyelets therein, said eyelets being disposed along said top edge in a spaced apart manner from said first to said second ends so that said first piece of material can be attached to the shower rod using a plurality of hooks wherein one hook passes through one each of said eyelets and then over the shower rod, wherein said second side of said first and second layers are contiguous to each other;

b) hook and loop material being disposed on inner faces of spaced bottom ends of said first and second layers of said first piece of material, with the bottom ends of said first and second layers overlapping said hook and loop material;

c) a second piece of material having top and bottom edges, first and second sides and first and second ends;

d) mating hook and loop material being disposed on said first and second sides of said top edge of said second piece of material so that said second piece of material is attached to said hook and loop material between said layers of said first piece of material to form said shower liner, whereby said layers of material in said first piece of material overlap on both sides the top edge of said second piece of material so that two layers of material support said second piece of material providing increased holding strength; and e) said first piece of material forming an upper part of the shower liner in the form of a valance.

2. The apparatus of claim 1, wherein said first piece of material extends 6-12 inches below the shower rod.

* * * * *